US008895904B1

(12) United States Patent
Briones, Jr.

(10) Patent No.: US 8,895,904 B1
(45) Date of Patent: Nov. 25, 2014

(54) EMERGENCY SHUTOFF SYSTEM FOR A COOKING APPLIANCE AND METHOD OF USE THEREOF

(71) Applicant: Ciriaco N. Briones, Jr., Escondido, CA (US)

(72) Inventor: Ciriaco N. Briones, Jr., Escondido, CA (US)

( * ) Notice: Subject to any disclaimer, the term of this patent is extended or adjusted under 35 U.S.C. 154(b) by 0 days.

(21) Appl. No.: 13/892,773

(22) Filed: May 13, 2013

Related U.S. Application Data

(62) Division of application No. 12/634,152, filed on Dec. 9, 2009, now Pat. No. 8,461,492.

(51) Int. Cl.
*H05B 1/02* (2006.01)

(52) U.S. Cl.
CPC ..... *H05B 1/0266* (2013.01)
USPC ..... 219/494; 219/491

(58) Field of Classification Search
USPC ..... 219/494, 491
See application file for complete search history.

(56) References Cited

U.S. PATENT DOCUMENTS 5,705,979 A * 1/1998 Fierro et al. ..... 340/517
2003/0010509 A1* 1/2003 Hoffman ..... 169/56
2010/0238639 A1* 9/2010 Butt et al. ..... 361/807

* cited by examiner

*Primary Examiner* — Huan Hoang
(74) *Attorney, Agent, or Firm* — Robert C. Montgomery; Montgomery Patent & Design

(57) ABSTRACT

An emergency shutoff system for a cooking appliance deactivates a cooking appliance upon the detection of smoke or rapidly rising heat. Three (3) embodiments are provided, depending on the presence of a gas or an electric model, each further comprises a combination heat and smoke detector located on the ceiling immediately above the appliance. The detector is connected to a control panel at the rear of the stove by a section of low voltage wiring. The control panel activates a shunt trip mechanism in the case of an electrically-powered stove or closes a low voltage solenoid valve in the case of gas-powered stove. Such features greatly reduce the affects of a fire at the cooking appliance should one occur.

2 Claims, 18 Drawing Sheets

EMERGENCY SHUTOFF SYSTEM FOR A COOKING APPLIANCE AND METHOD OF USE THEREOF

RELATED APPLICATIONS

The present invention was first described in and claims the benefit of U.S. Provisional Application No. 61/121,804 filed Dec. 11, 2008, and U.S. Nonprovisional application Ser. No. 12/634,152 filed Dec. 9, 2009, the entire disclosures of which are incorporated herein by reference.

FIELD OF THE INVENTION

The present invention relates generally to electric home appliances, and in particular, to a system for sensing dangerous conditions and the subsequent automatic shutoff of electric home appliances.

BACKGROUND OF THE INVENTION

Electric home appliances represent an ever-growing percentage of household amenities. In particular, electric version of items such as stoves, microwaves, toasters, and the like dominate the marketplace. The automatic nature of such items makes for easy preparation, maintenance, and accurate heating of food, beverages, and the like. Such electric appliances allow a user to automatically heat the device to specific temperatures, allow a user to time preparation in an automated fashion, and allow a user to perform many other similar tasks in a hands-free, automatic manner.

The shift to automatic food heating and preparation appliances, among other household appliances, has led to an increase in house fire and the like as a result of increased absence of a user during the time of use. Such accidents can easily result if a burner, heater, or other similar component or appliance is left on and unattended for a period of time. Fires may result from gas buildup, overheating, a misplaced item which catches fire, or any number of other mishaps which would potentially be mitigated by the presence and attention of the user.

Various attempts have been made to provide automatic safety features for stoves and the like. Examples of these attempts can be seen by reference to several U.S. Pat. No. 5,094,259, issued in the name of Hsu, describes an automatic shut-off safety device for gas stoves. The Hsu device detects the extinguishment of a flame on a gas stove and shuts off the flow of gas to prevent a dangerous gas buildup.

U.S. Pat. No. 6,032,663, issued in the name of Pencheon, describes a stove emergency cutoff system. The Pencheon device has a sensor located above a stove's burners which senses the presence of a large flame and shuts off the corresponding burner.

U.S. Pat. No. 6,046,441, issued in the name of Daffron, describes a combustion activated device for disabling an electrical appliance. The Daffron apparatus can sense the presence of a flame on an electrical appliance and subsequently shuts off power to the appliance.

While these devices fulfill their respective, particular objectives, each of these references suffer from one (1) or more of the aforementioned disadvantages. Many such devices are not adaptable to types of electric stoves. Also, many such devices do not sense an adequate range of dangerous conditions and instead only focus on one particular situation. In addition, many such devices are not easily retrofitted to existing appliances. Furthermore, many such devices are not adaptable to a variety of appliances. Finally, many such devices involve physically intrusive components which may be either in the way of a user of the appliance or perceived as aesthetically unpleasing. Accordingly, there exists a need for an emergency shutoff system for cooking appliances without the disadvantages as described above. The development of the present invention substantially departs from the conventional solutions and in doing so fulfills this need.

SUMMARY OF THE INVENTION

In view of the foregoing disadvantages inherent in the prior art, it has been observed that there is need for an emergency shut-off system for deactivating an electric stove upon sensing smoke or heat and thereby reducing kitchen fires. Such an electric stove preferably has a first plug connected to a first outlet for receiving power therefrom. The first outlet is electrically mated to a circuit breaker box including a ground fault circuit interrupter.

Notably, the emergency shut-off system preferably includes a smoke detector having an input and an output respectively, and an emergency shut-off device adapted to be interconnected to the electric stove. Such an emergency shut-off device may be interconnected to the input and the output of the smoke detector. In this manner, upon detecting smoke or heat, the smoke detector sends a current to the emergency shut-off device which concurrently trips the ground fault circuit interrupter thereby terminating power to the first outlet and the electric stove.

Such an embodiment may further include a corresponding method of utilizing an emergency shut-off system for deactivating an electric stove upon sensing smoke or heat and thereby reducing kitchen fires. Such an electric stove is preferably connected to a first outlet for receiving power therefrom. The first outlet may be electrically mated to a circuit breaker box including a ground fault circuit interrupter. Notably, such a method preferably includes the steps of: providing a smoke detector having an input and an output respectively; providing and interconnecting an emergency shut-off device to the electric stove as well as the input and the output of the smoke detector; and upon detecting smoke or heat, terminating power to the first outlet and the electric stove by the smoke detector sending a current to the emergency shut-off device and thereby tripping the ground fault circuit interrupter.

In one embodiment, the emergency shut-off device may include a top housing and a bottom housing removably connected thereto, a circuit board located within the top and bottom housings, first and second resistors connected to the circuit board, and a contactor connected to a surface of the circuit board. Such a contactor may be a relay receiving a five volt direct current from the output of the smoke detector.

In one embodiment, the emergency shut-off system may further include a transmitter connected to the smoke detector. Such a transmitter includes an internal transmitter power supply for providing power to the transmitter. A receiver may be interconnected to the electric stove panel. Such a receiver may include a receiver power supply for providing power to the receiver. Notably, the transmitter transmits a wireless signal when smoke or heat is detected. In this manner, the receiver receives the signal which terminates power to the electric stove.

In one embodiment, the present invention may include an emergency shut-off system for deactivating an electric stove upon sensing smoke or heat and thereby reducing kitchen fires. Such an electric stove preferably has a first plug connected to a first outlet for receiving power therefrom. The first outlet may be electrically mated to a circuit breaker box without a ground fault circuit interrupter. Notably, such an emergency shut-off system preferably includes a smoke detector including an input and an output as well as a reset button and a battery interconnected thereto. An emergency shut-off device is adapted to be interconnected to the electric stove wherein such an emergency shut-off device is interconnected to the input and the output of the smoke detector. Also, the reset button may be interconnected to the emergency shut-off device.

Notably, the emergency shut-off device may further include a second plug adapted to be interconnected to a second outlet, a junction box adapted to be interconnected to the second outlet, a third plug adapted to be plugged into the second outlet, and a forty amp (40 A) contactor having a 120-Volt alternating current activation coil wired to the third plug. Such a contactor preferably has a first pair of poles adapted to be interconnected to a 230-Volt alternating current coming from the circuit breaker. The contactor may further have a second pair of poles adapted to be interconnected to the first outlet. In this manner, upon detecting smoke or heat, the smoke detector sends a current to the emergency shut-off device which terminates power to the first outlet and the electric stove.

Such an embodiment may further include a method of utilizing an emergency shut-off system for deactivating an electric stove upon sensing smoke or heat and thereby reducing kitchen fires. The electric stove having a first plug connected to a first outlet for receiving power therefrom. The first outlet may be electrically mated to a circuit breaker box without a ground fault circuit interrupter. Notably, such a method preferably includes the steps of: providing a smoke detector including an input and an output respectively; and providing and interconnecting an emergency shut-off device to the electric stove as well as the input and the output of the smoke detector.

The step of providing the emergency shut-off device includes the sub-steps of: providing and interconnecting a second plug to a second outlet; providing and interconnecting a junction box to the second outlet; providing and interconnecting a third plug into the second outlet; and providing and wiring a forty amp contactor having a 120-Volt alternating current activation coil to the third plug. Such a contactor preferably has a first pair of poles adapted to be interconnected to a 230-Volt alternating current coming from the circuit breaker. The contactor further has a second pair of poles adapted to be interconnected to the first outlet.

Such method further includes the steps of providing and interconnecting a reset button and a battery of the smoke detector to the emergency shut-off device. In this manner, upon detecting smoke or heat, the smoke detector sends a current to the emergency shut-off device and thereby terminates power to the first outlet and the electric stove.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
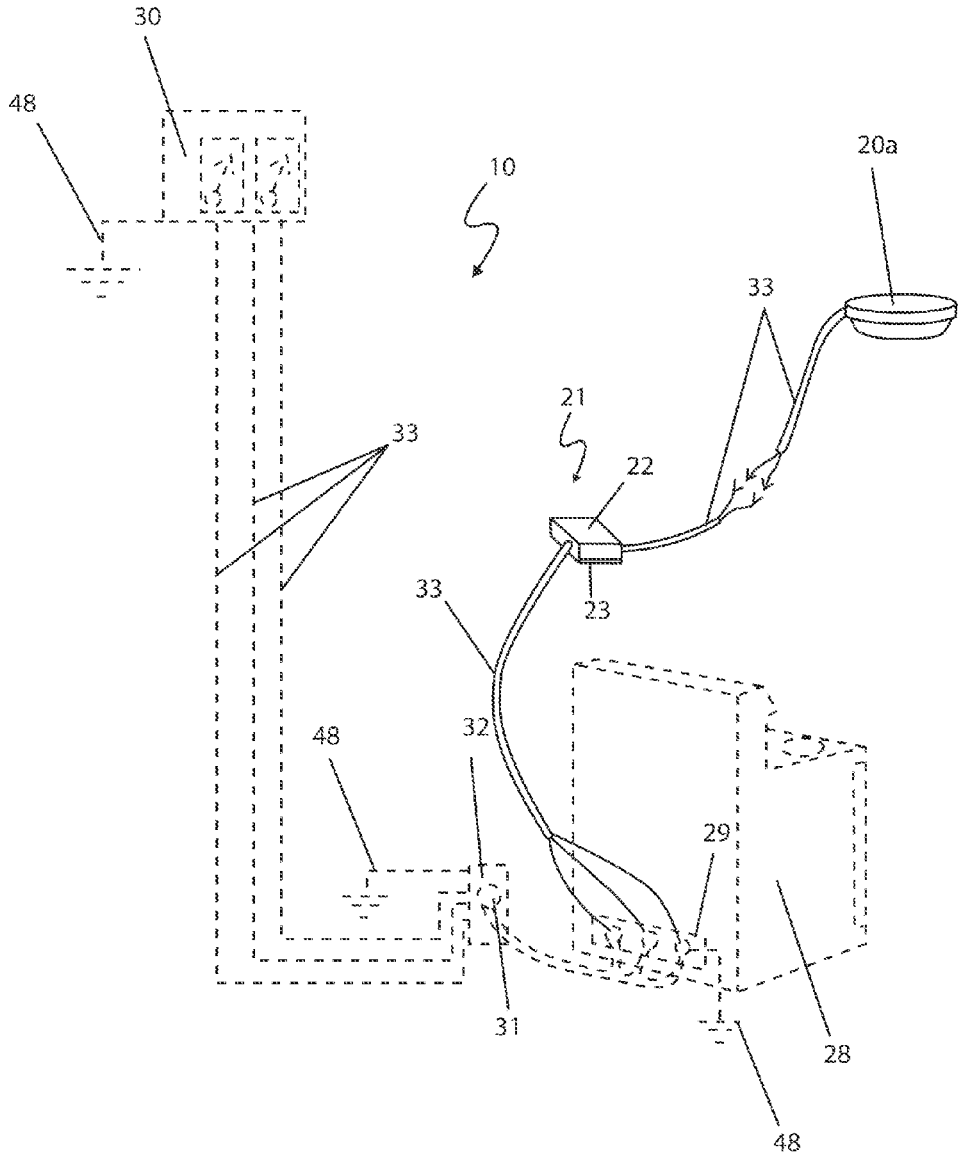
FIG. 1 is an environmental view of an emergency shut-off system for a cooking appliance 10, according to a preferred embodiment of the present invention.

10 emergency shut-off system for cooking appliances
20*a* smoke detector
20*b* reset button
20*c* battery
20*d* voltage output
21 emergency shut-off device
22 top housing
23 bottom housing
24 circuit board
25 first resistor
26 second resistor
27 contactor

28 electric stove
29 electric stove panel
30 circuit breaker box with GFCI
31 first plug
32 first outlet
33 electrical wiring
34 first alternate emergency shut-off system
35 circuit breaker box without GFCI
36 junction box
37 second outlet
38 second plug
39 third plug
48 electrical grounding
55 second alternate emergency shut-off system
60 transmitter
61 receiver
62 transmitter power supply
63 receiver power supply
64 signal

DETAILED DESCRIPTION OF THE PREFERRED EMBODIMENT

The best mode for carrying out the invention is presented in terms of its preferred embodiment, herein depicted within FIGS. 1 through 5 and alternately within FIGS. 6 through 18. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an emergency shut-off system for a cooking appliance (herein described as the "system") 10, which provides a means to preferably deactivate an electric stove 28 upon sensing smoke, thereby reducing the number kitchen fires. Other cooking appliances such as toaster ovens, microwaves, or the like may be utilized without limiting the functions of the system 10. The system 10 comprises a smoke detector 20*a* and an emergency shut-off device 21 which are interconnected to an existing electric stove 28. Said system 10 is preferably utilized therewith a circuit breaker box that comprises a ground fault circuit interrupter (GFCI) 30, yet a first alternate embodiment 34 is illustrated for structures without the GFCI. A second alternate embodiment 55 is illustrated to produce a wireless system.

Figure 2:
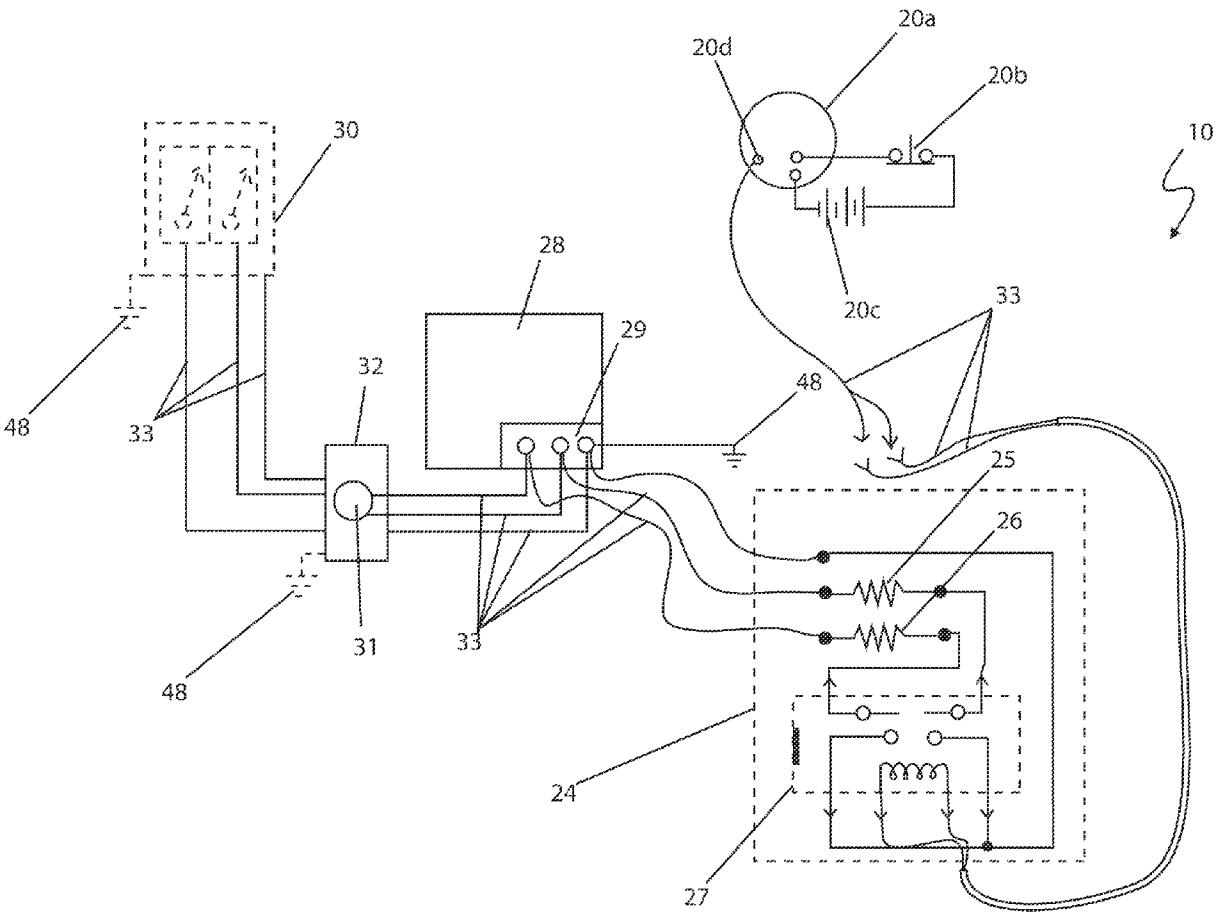
FIG. 2 is an electrical schematic of the emergency shut-off system for a cooking appliance 10, according to a preferred embodiment of the present invention.

Referring now to FIG. 1, an environmental of the system 10 and FIG. 2, an electrical schematic of the system 10, according to the preferred embodiment of the present invention, are disclosed. The system 10 comprises a smoke detector 20*a* and an emergency shut-off device 21 (also see FIG. 2), thereby providing a means to sense smoke or high heat produced from the electric stove 28 and providing a means to trip the circuit breaker box with GFCI 30. Said emergency shut-off device 21 is preferably located on an interior portion of the smoke detector 20*a* and is illustrated herein as being located outside of the smoke detector 20*a* for illustration purposes only. The smoke detector 20*a* is installed thereon the ceiling of a kitchen or other room above and offset from the electric stove 28. Said emergency shut-off 21 is interconnected to an appropriate input and output of the smoke detector 20*a* with appropriately gauged electrical wiring 33. The smoke detector 20*a* is preferably a conventional circular smoke sensor comprising a twelve (12) to twenty-four (24) volt DC input, an integral reset button, a preferable eighty-five decibel (85 db) alarm, and a preferable 5-Volt direct current (DC) output similar to a SYSTEM SENSOR© smoke detector, yet other smoke sensors with various alarms, inputs, and outputs may be utilized without limiting the functions of the system 10.

In use, the smoke detector 20*a* works in a conventional manner by sensing the presence of smoke or rising heat via an internal sensor and emitting the alarm. The detection of smoke or heat triggers the DC output therein the smoke detector 20*a* which sends current to the emergency shut-off device 21 activating a twelve milliamp (12 mA) emergency shut-off device 21 which is appropriately interconnected with electrical wiring 33 to the electric stove panel 29 located on a rear portion of the electric stove 28. The electric stove 28 receives power via a first plug 31 connected to a first outlet 32 which supplies the conventional 230-Volts alternating current (AC) to the electric stove 28. The electric stove 28 comprises conventional and existing electrical grounding 48. The first outlet 32 is interconnected to the circuit breaker with GFCI 30 which receives power via a conventional electrical power grid further comprising appropriate and existing electrical grounding 48. Current is sent to the electric stove 28 via the emergency shut-off device 21 which concurrently trips the circuit breaker with GFCI 30 and terminates power to the first outlet 32 which simultaneously terminates power to the electric stove 28. Once the structure is cleared of smoke or high heat a user depresses the reset button 20*b* thereon the smoke detector 20*a*, thereby stopping the alarm. Said user also resets the circuit breaker box with GFCI 30 in a conventional manner, thereby enabling current flow to the electric stove 28.

Figure 3:
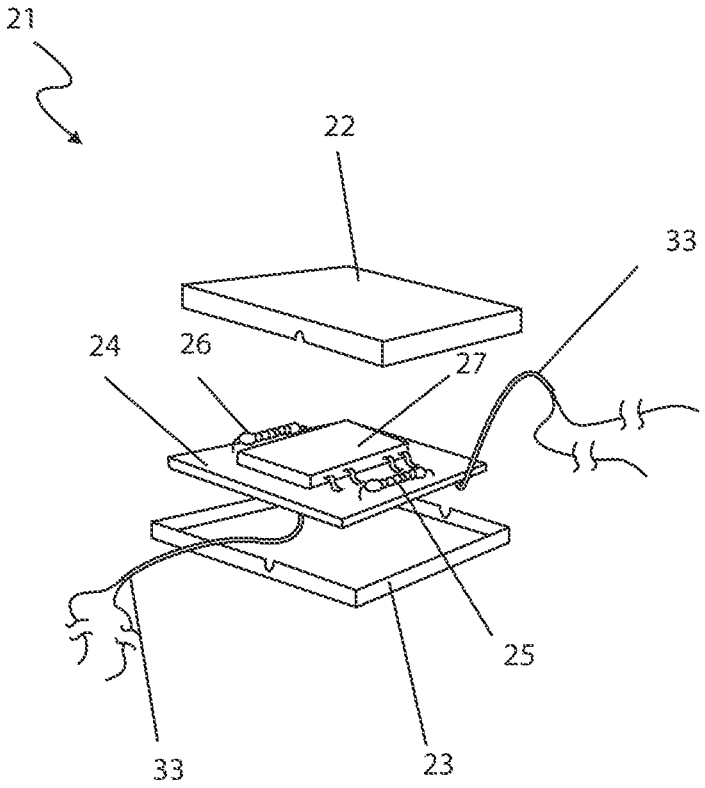
FIG. 3 is a partially exploded perspective view an emergency shut-off device 21, according to a preferred embodiment of the present invention.
Figure 4:
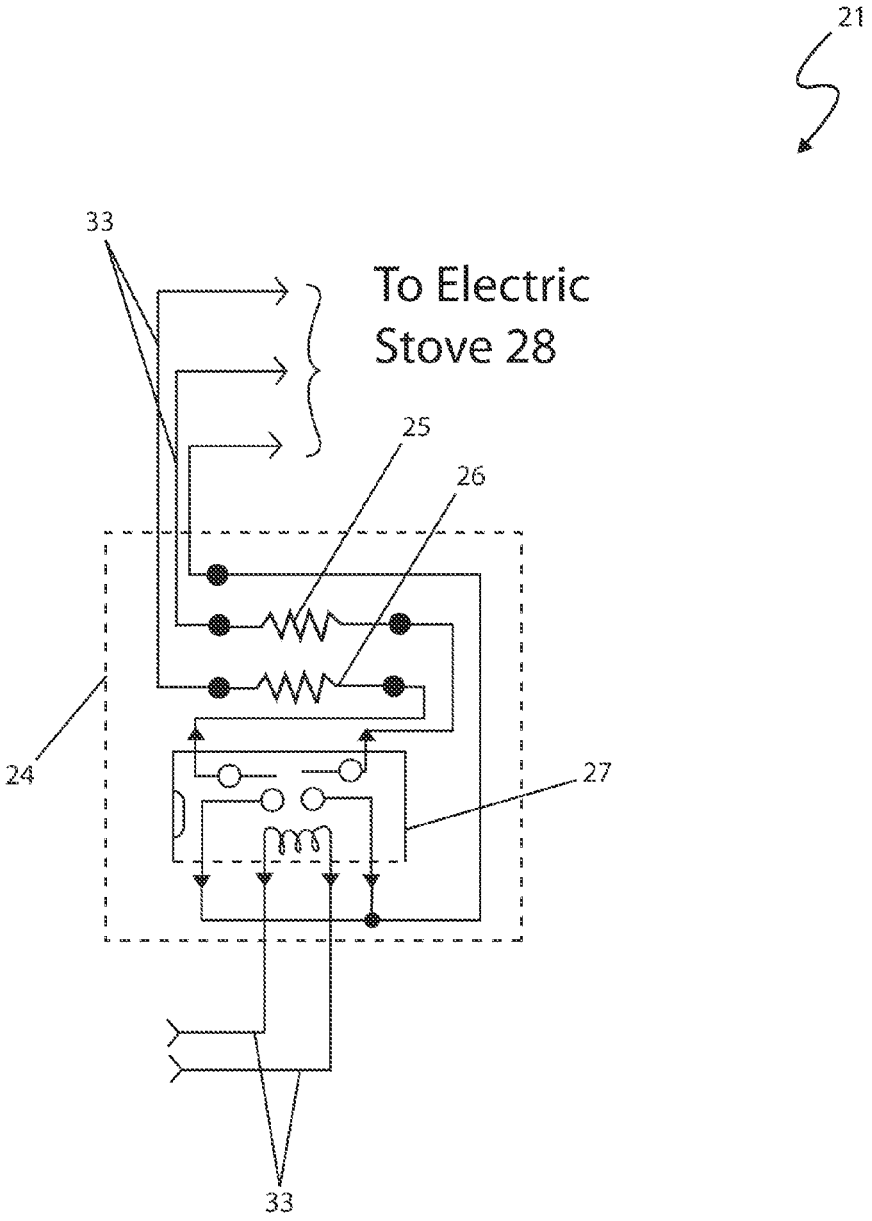
FIG. 4 is an electrical schematic of the emergency shut-off device 21, according to a preferred embodiment of the present invention.
Figure 5:
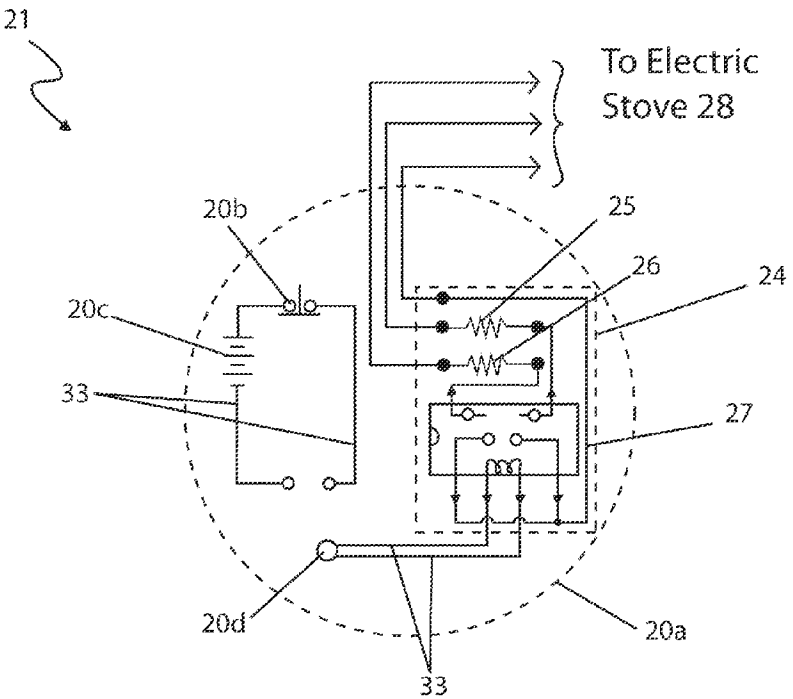
FIG. 5 is an electrical schematic the emergency shut-off device 21 therein a smoke detector 20*a*, according to a preferred embodiment of the present invention.

Referring now to FIG. 3, a partially exploded perspective view an emergency shut-off device 21, FIG. 4, is an electrical schematic of the emergency shut-off device 21, and FIG. 5, an electrical schematic the emergency shut-off device 21 therein a smoke detector 20*a*, according to the preferred embodiment of the present invention, are disclosed. The emergency shut-off device 21 is a rectangular device which comprises a top housing 22, a bottom housing 23, a circuit board 24, a first resistor 25, a second resistor 26, and a contactor 27. The top housing 22 and bottom housing 23 provide a secure enclosure to internal components 24, 25, 26, 27 and are fastened together via fastening means such as, but not limited to: interference fitting, tabs, or the like. The housings 22, 23 are preferably fabricated from a nonconductive plastic material, but other materials may be utilized without limiting the functions of the system 10. The circuit board 24 supports and connects the electrical components 25, 26, 27 via conventional internal copper traces. The surface-mounted contactor 27 is a common mini relay which requires a 5-Volt DC coil supply which is received from the output on the smoke detector 20*a*. Said contactor 27 is soldered to an intermediate portion of the circuit board 24. The first resistor 25 and the second resistor 26 are both common ten kilo-ohm (10 kΩ) two Watt (2 W) resistors soldered to appropriate portion on the circuit board 24 thereto correspond to an appropriate pin-out of the contactor 27. Electrical wiring 33 interconnects the emergency shut-off device 21 from the smoke detector 20*a* to the electric stove 28.

The smoke detector 20*a* comprises a conventional user replaceable battery 20*c*, thereby enabling a current to be sent via electrical wiring 33 to a reset button 20*b*. The reset button 20*b* is a conventional normally-closed electrical switch such as, but not limited to: a pushbutton, a slide switch, or the like.

Said reset button 20*b* is interconnected thereto the smoke detector 20*a*, battery 20*c*, and emergency shut-off device 21 which further comprises a pair of resistors 25, 26 and a contactor 27 as abovementioned. Electrical wiring 33 connected to the internal electrical devices is routed out of the smoke detector 20*a*, thereby enabling connection to an appropriate appliance.

Figure 6:
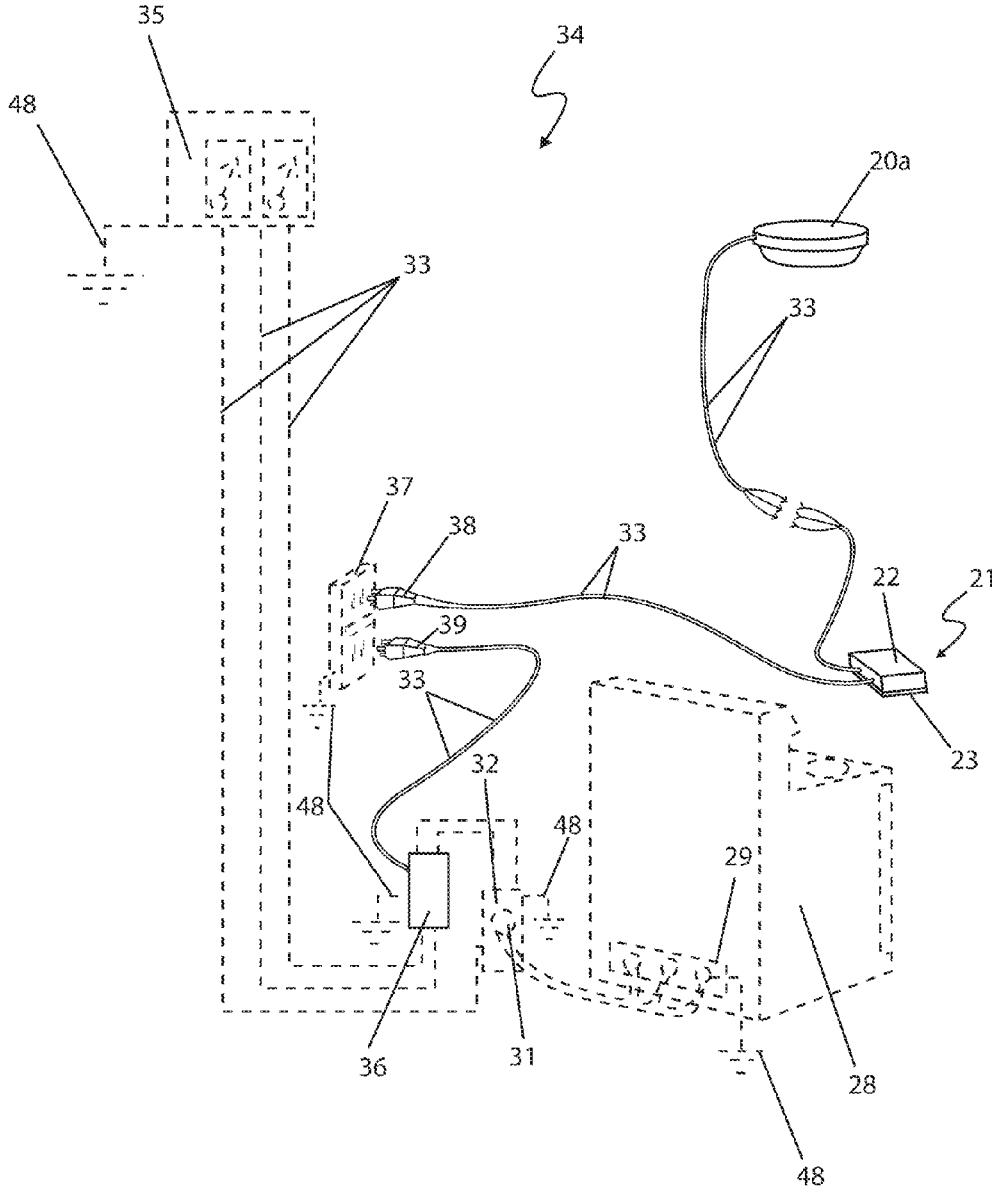
FIG. 6 is an environmental view of a first alternate emergency shut-off system 34, according to an alternate embodiment of the present invention.
Figure 7:
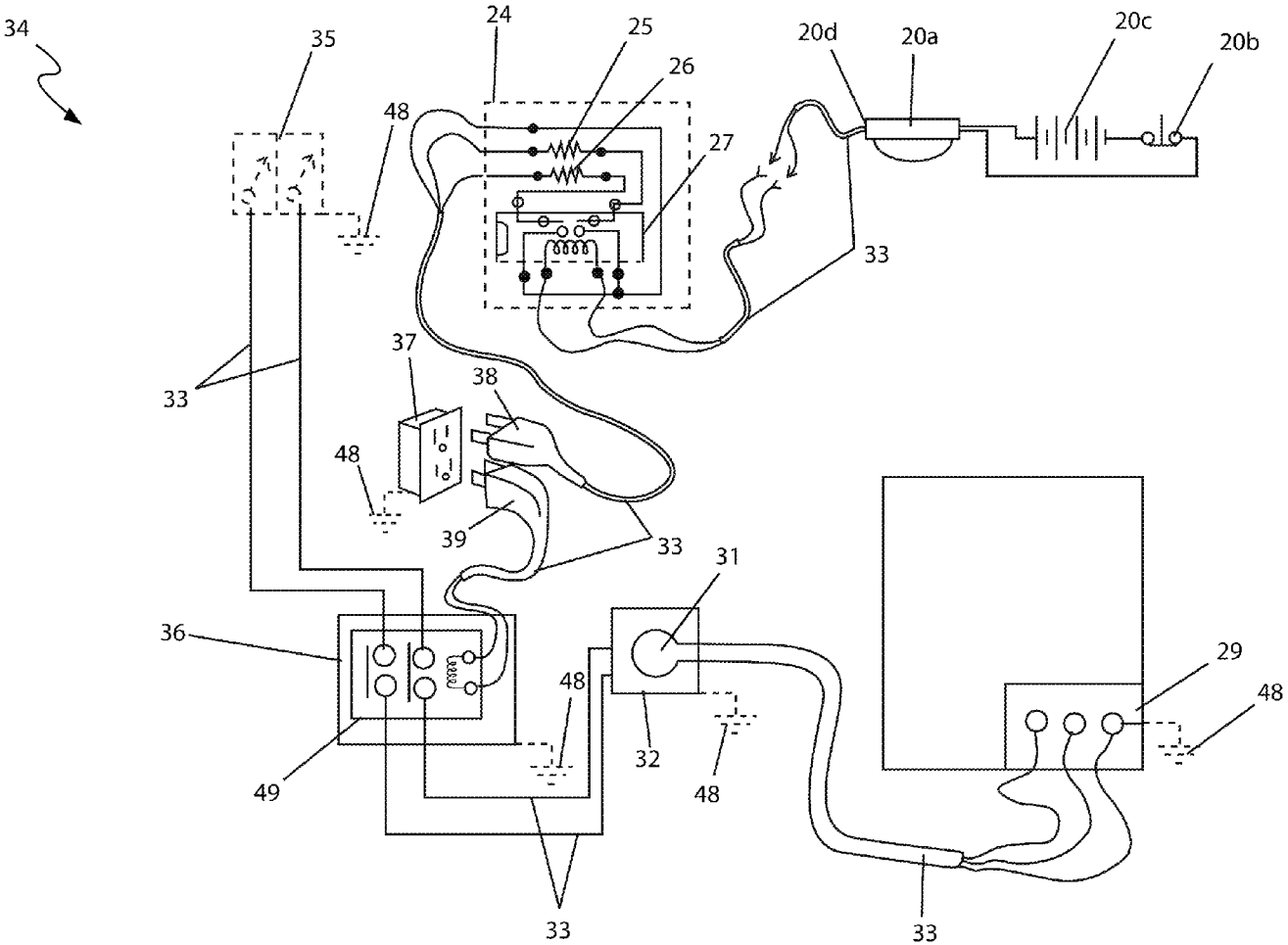
FIG. 7 is a schematic diagram of the first alternate emergency shut-off system 34, according to an alternate embodiment of the present invention.
Figure 8:
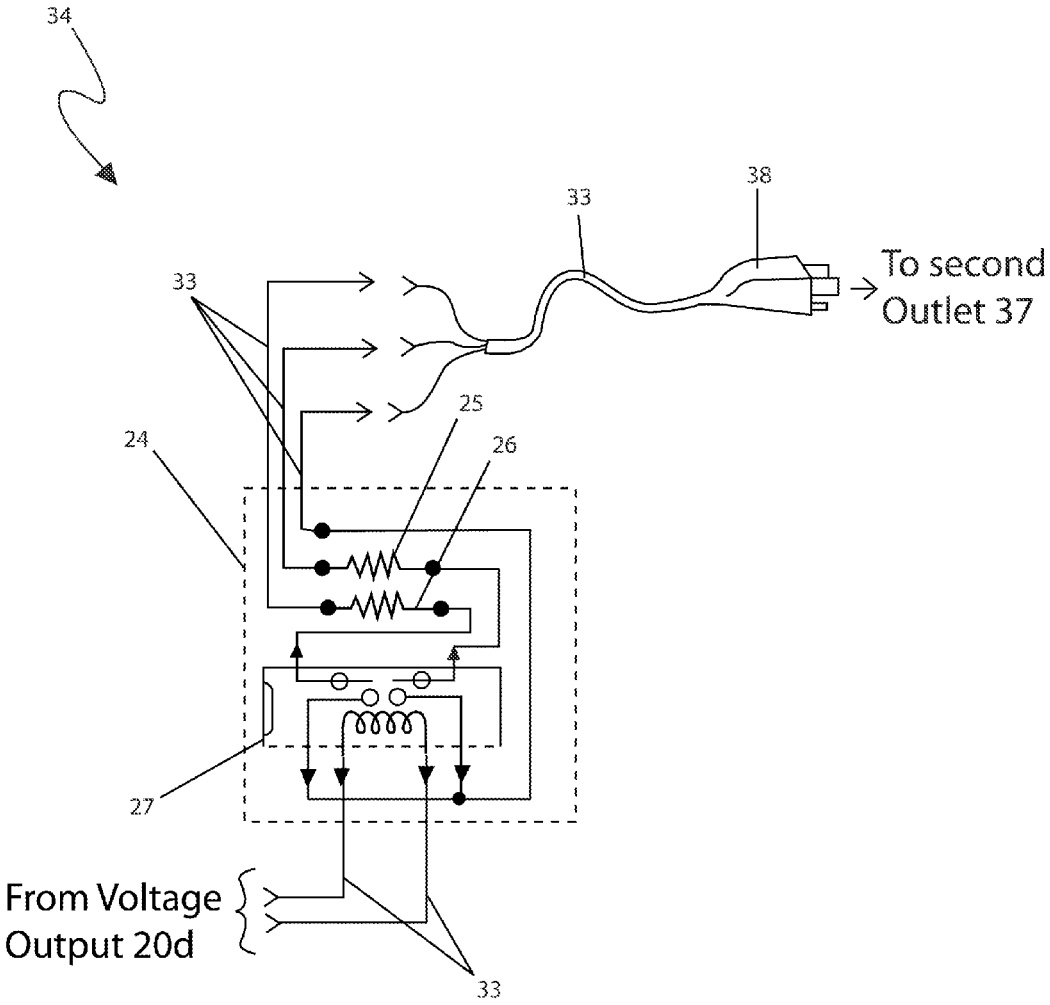
FIG. 8 is an electrical schematic diagram of the first alternate emergency shut-off system 34 depicting a second plug 38, according to an alternate embodiment of the present invention.
Figure 9:
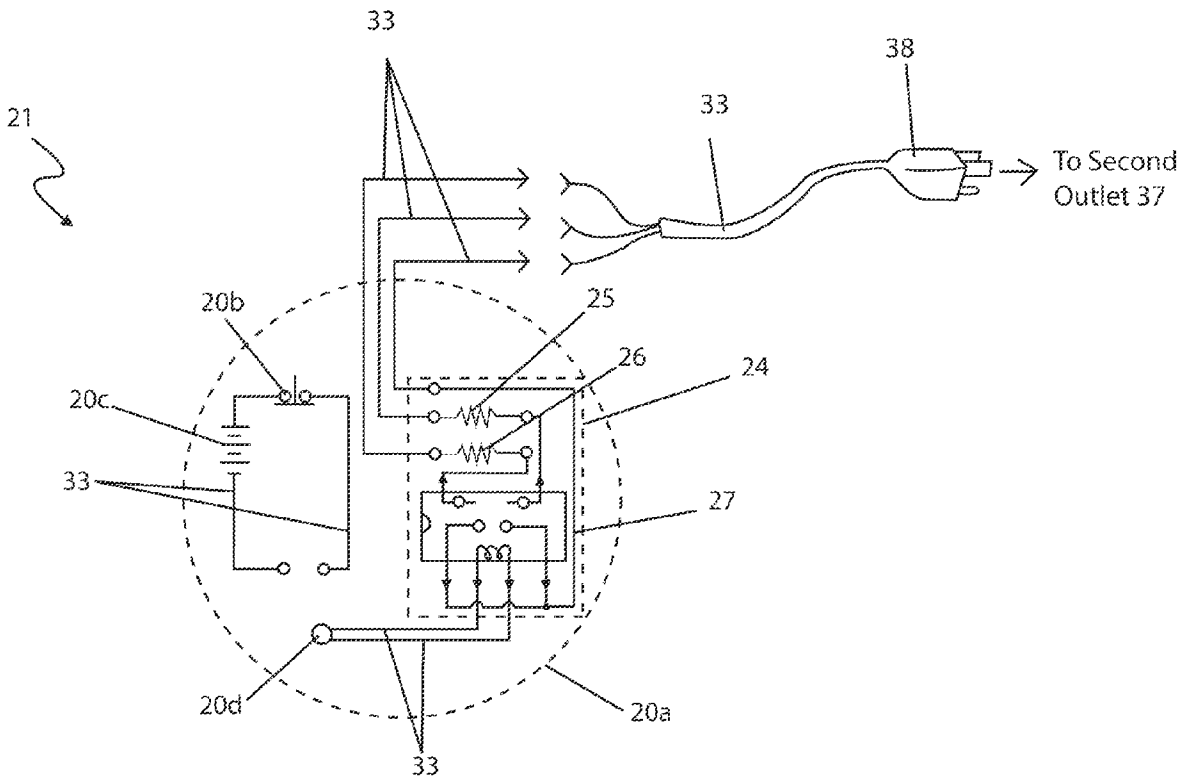
FIG. 9 is an electrical schematic the emergency shut-off device 21 therein a smoke detector 20*a* depicting the second plug 38, according to a preferred embodiment of the present invention.
Figure 10:
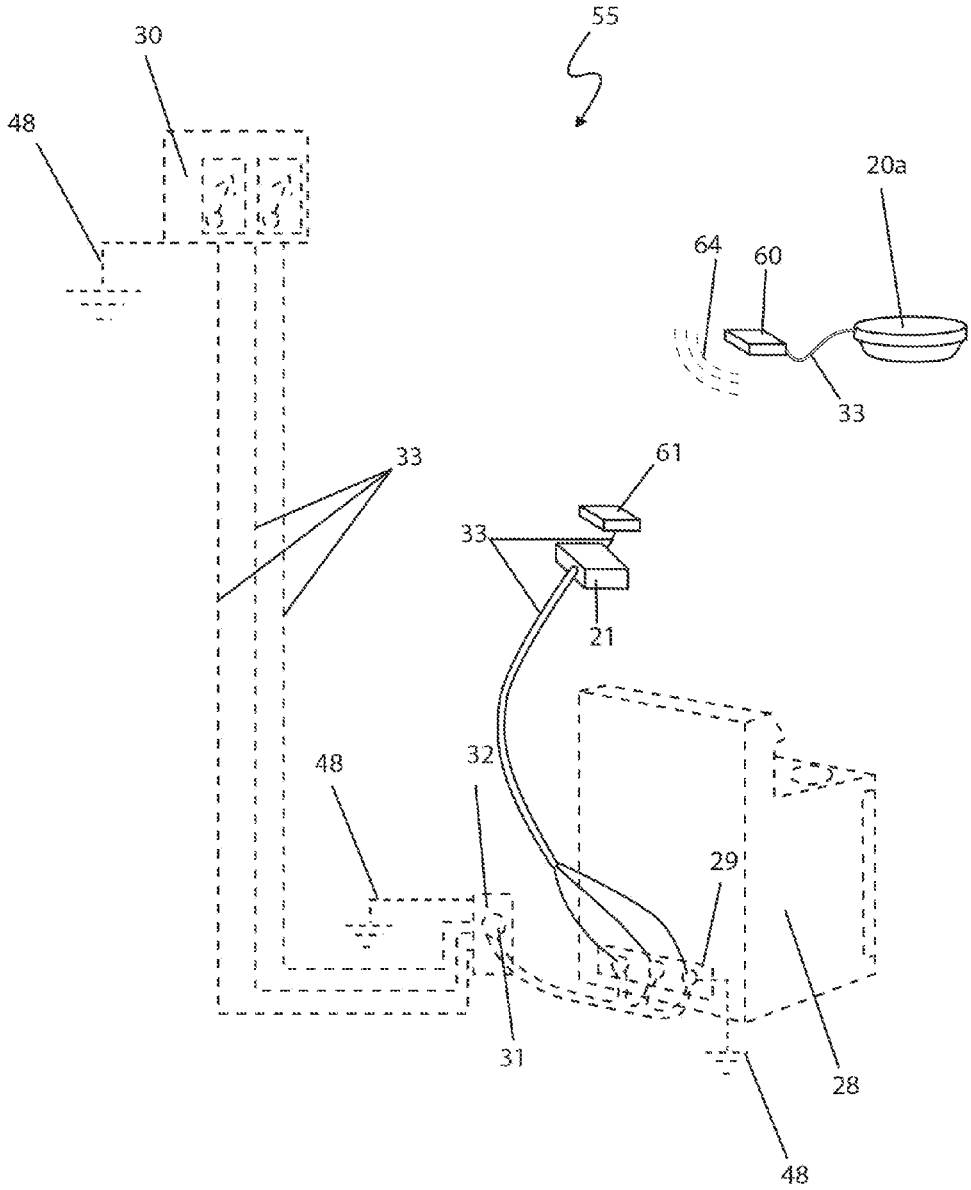
FIG. 10 is an environmental view of a second alternate emergency shut-off device 55, according to another alternate embodiment of the present invention.
Figure 11:
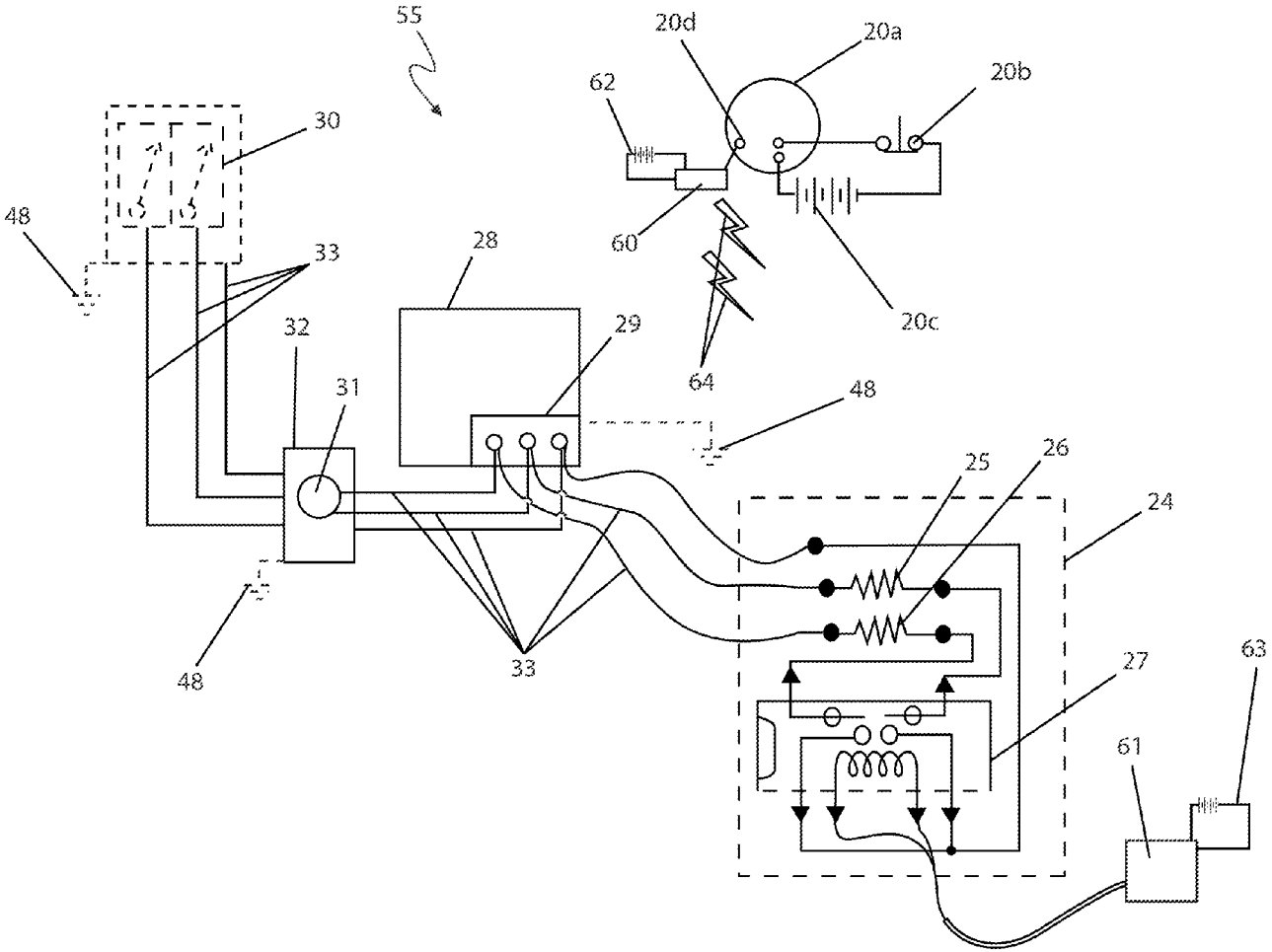
FIG. 11 is an electrical schematic of the second alternate emergency shut-off device 55, according to another alternate embodiment of the present invention.
Figure 12:
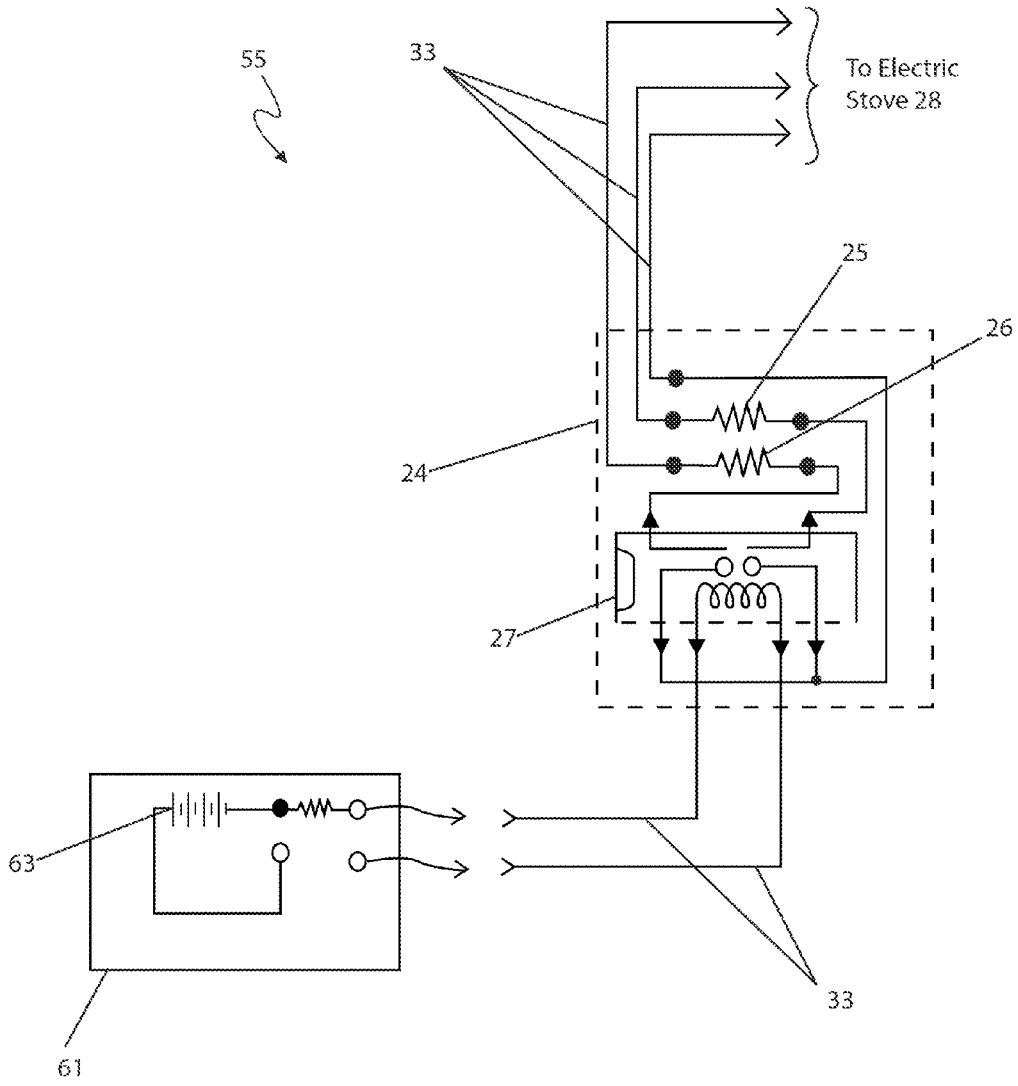
FIG. 12 is another electrical schematic of the second alternate emergency shut-off device 55, according to another alternate embodiment of the present invention.
Figure 13:
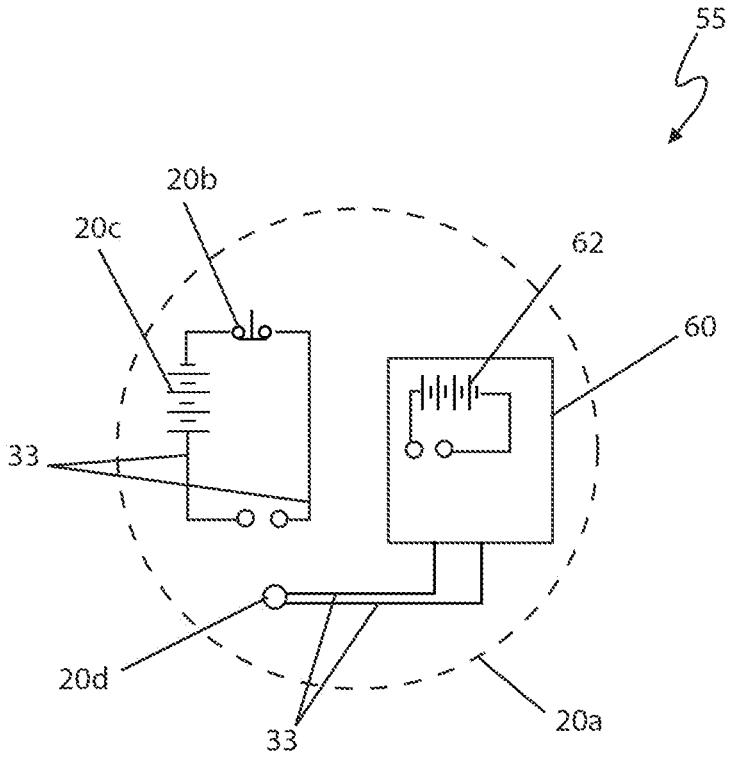
FIG. 13 is another electrical schematic of the second alternate emergency shut-off device 55, according to another alternate embodiment of the present invention.
Figure 14:
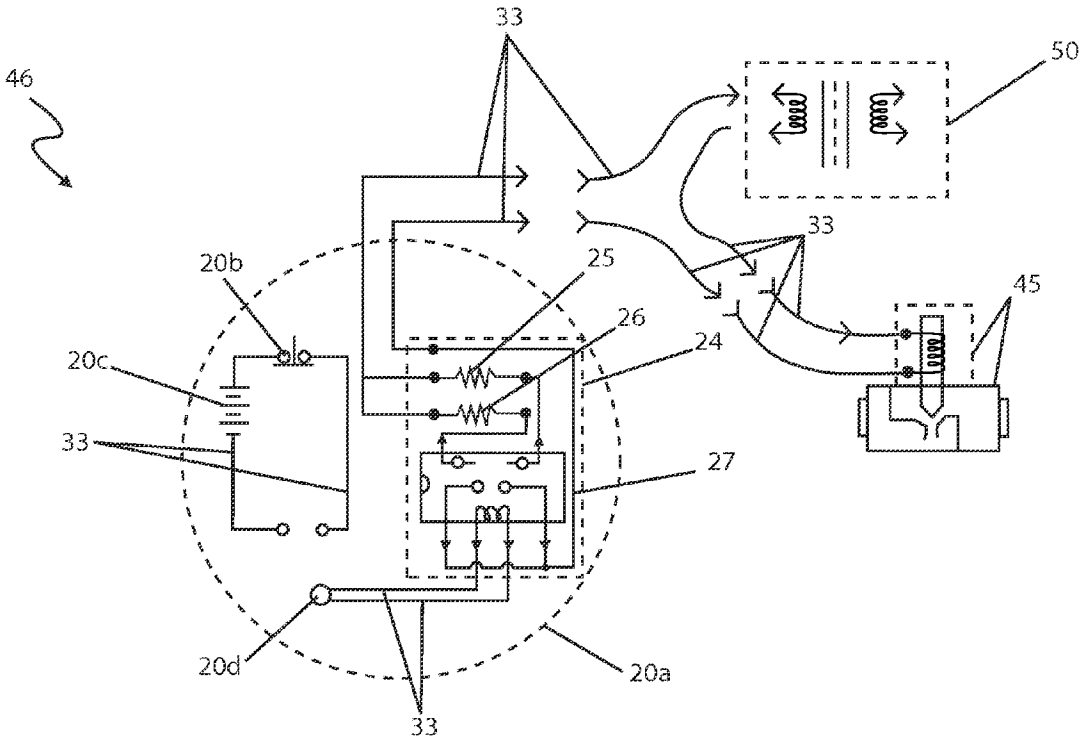
FIG. 14 is an electrical schematic of the alternate emergency shut-off device 46 depicting the solenoid 45 and the solenoid power supply 50 wired to the smoke detector 20*a*, according to another alternate embodiment of the present invention.

Referring now to FIG. 6 through FIG. 9, various views of a first alternate emergency shut-off system 34 according to the preferred embodiment of the present invention, are disclosed. FIG. 6 depicts an environmental view of a first alternate emergency shut-off system 34, FIG. 7 depicts a schematic diagram of the first alternate emergency shut-off system 34, FIG. 8 depicts an electrical schematic diagram of the first alternate emergency shut-off system 34 depicting a second plug 38, and FIG. 9 depicts an electrical schematic the emergency shut-off device 21 therein a smoke detector 20*a* depicting the second plug 38. The first alternate emergency shut-off system 34 is utilized within structures with a circuit breaker box without GFCI 35. Said first alternate emergency shut-off system 34 comprises the abovementioned smoke detector 20*a* and emergency shut-off device 21, yet the electric stove 28 it is interconnected to a second outlet 37 via a second plug 38. The second outlet 37 is comprised of a conventional duplex outlet which comprises an internal GFCI circuit. Said second outlet 37 is interconnected to a junction box 36 which houses a common forty amp (40 A) contactor 27 with 120-VAC activation coil wired to a third plug 39 which is plugged into a second one-hundred-and-twenty (120) VAC wall outlet with GFCI 37, the two (2) poles of the contactor 27 is interconnected to the 230-VAC coming from the circuit breaker without GFCI 35 and the other two (2) poles is interconnected to the first outlet 32 where the electric stove 28 is plugged into via first plug 31. The junction box 36 may comprise other rated contactors and should not be considered a limiting factor of the system 10. In use, when smoke or heat is detected from the smoke detector 20*a* 5-Volt DC is sent to the emergency shut-off device 21, a twelve milliamp (12 mA) ground fault shunt, which triggers the second outlet 37 to trip the GFCI and prohibit current flow to the 120-VAC coil of the contactor 27, thereby disengaging the contacts of said contactor 27 and prohibiting the flow of current to electric stove 28. The user preferably resets the second outlet 37 and depresses the reset button 20*b* on the smoke detector 20*a* when the structure has been cleared as abovementioned.

Figure 15:
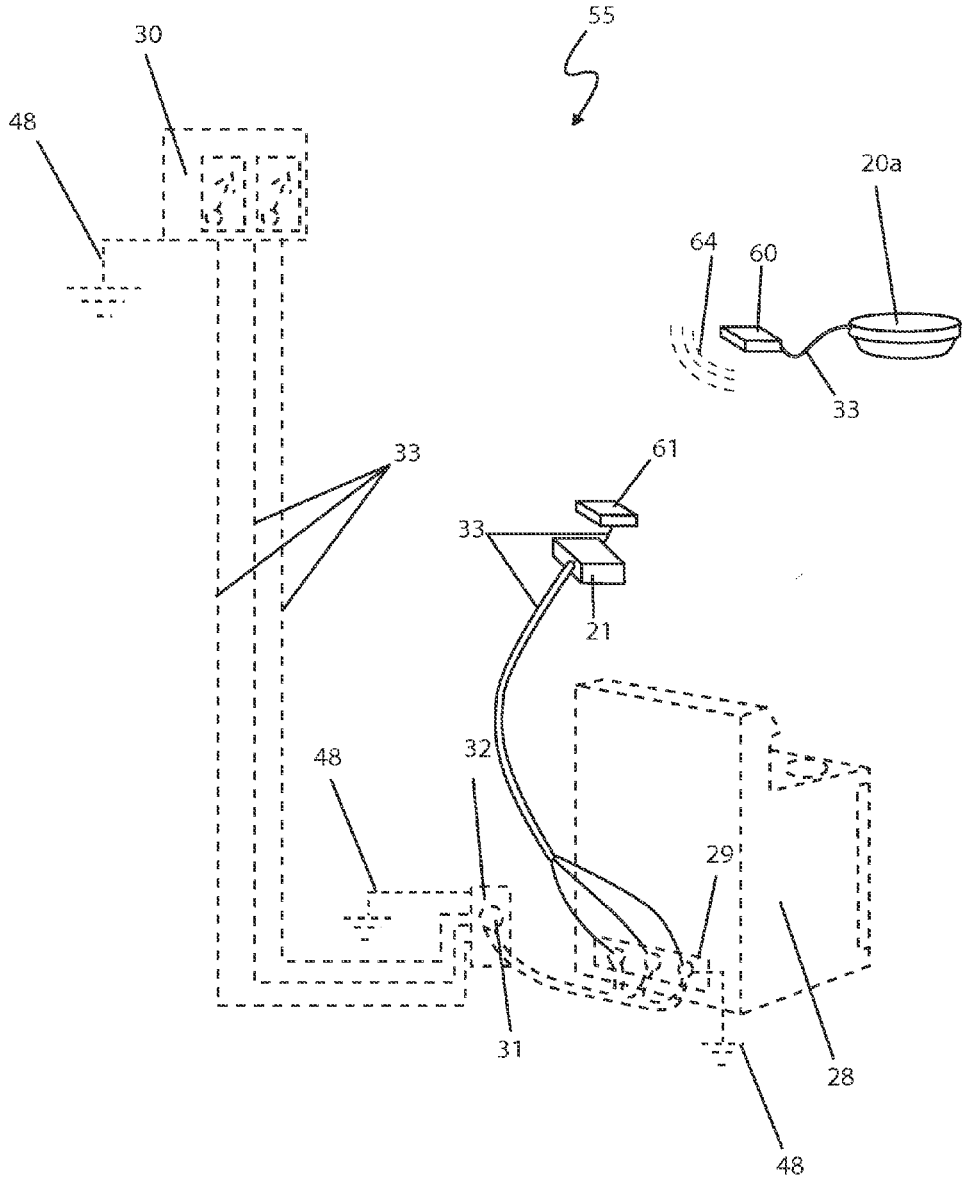
FIG. 15 is an environmental view of a third alternate emergency shut-off device 55, according to another alternate embodiment of the present invention.
Figure 16:
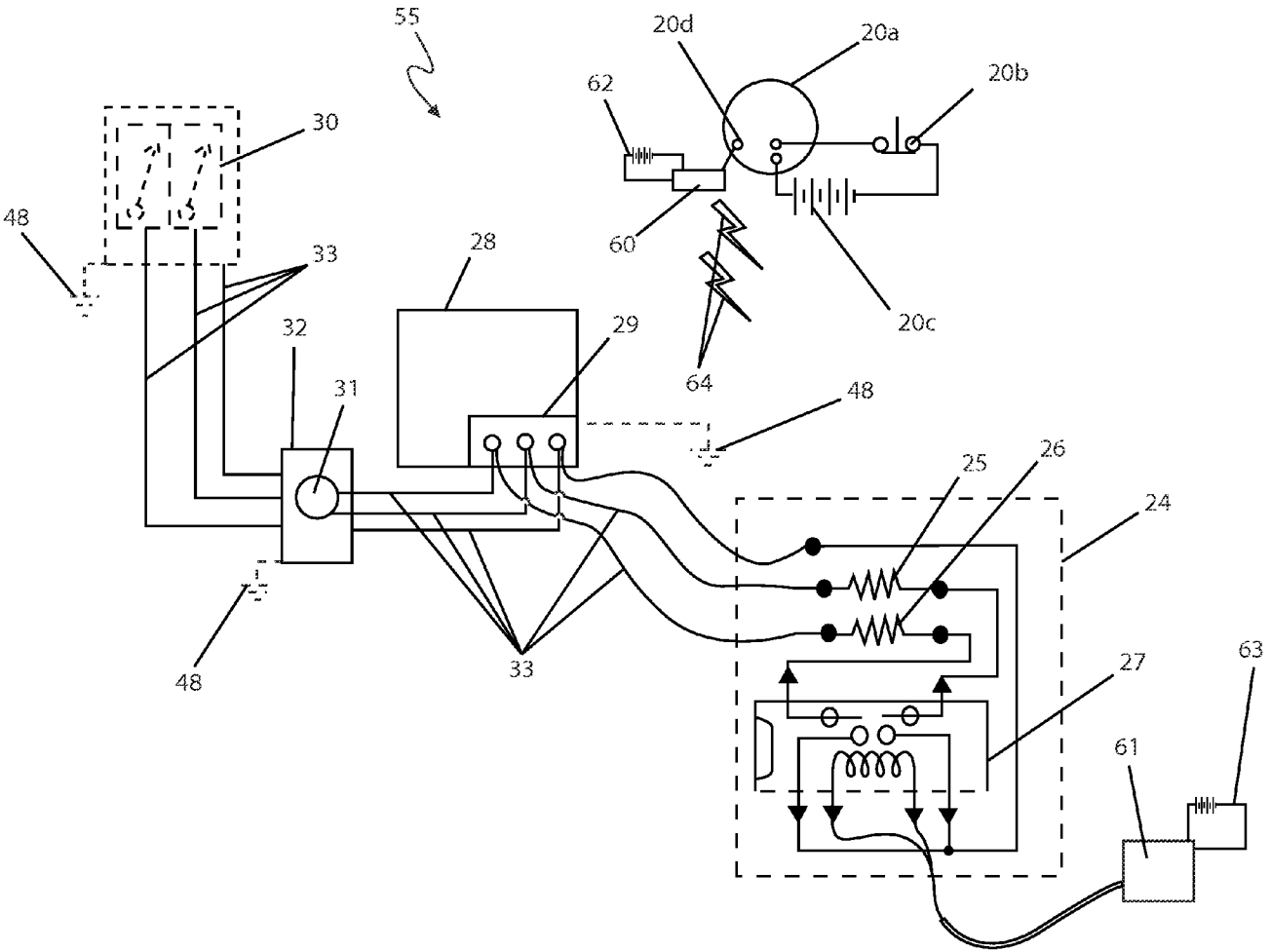
FIG. 16 is an electrical schematic of the third alternate emergency shut-off device 55, according to another alternate embodiment of the present invention.
Figure 17:
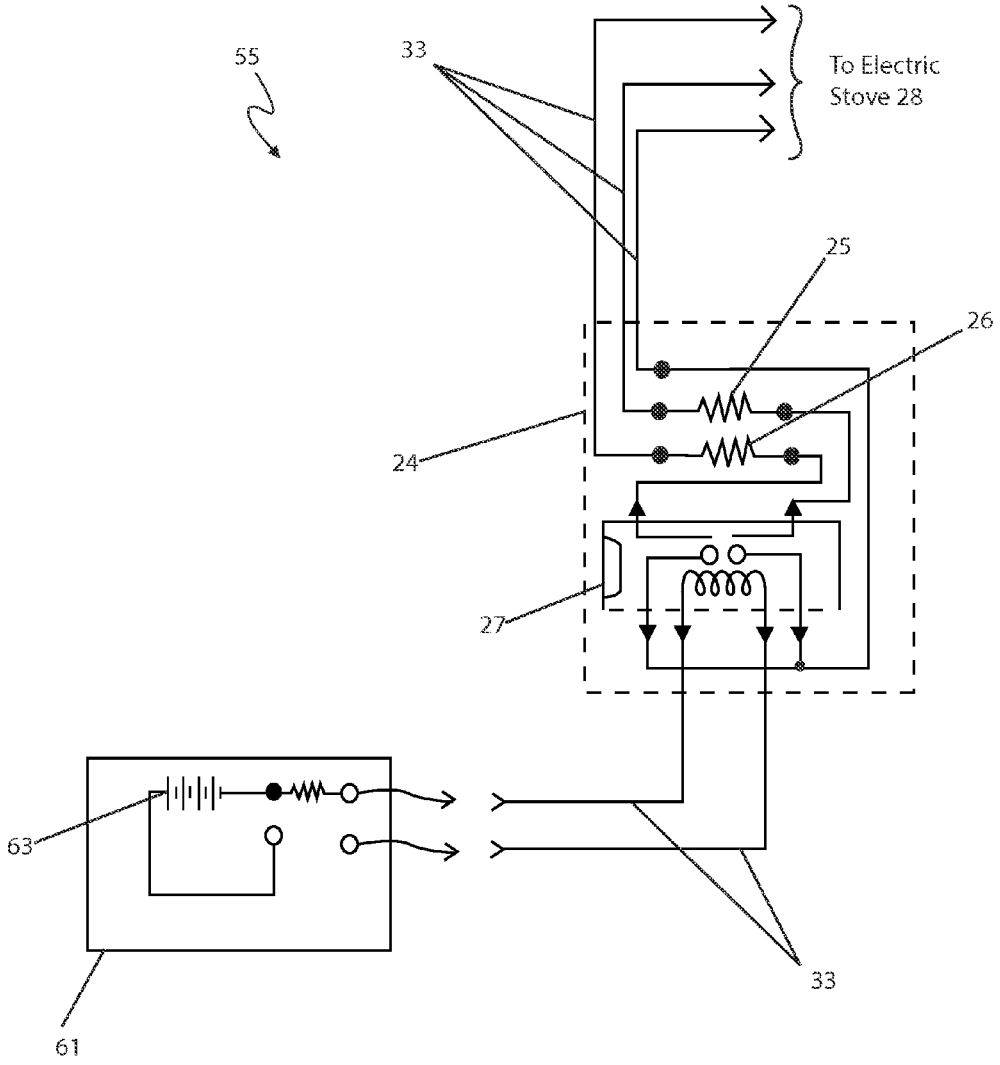
FIG. 17 is another electrical schematic of the third alternate emergency shut-off device 55, according to another alternate embodiment of the present invention; and, FIG. 18 is another electrical schematic of the third alternate emergency shut-off device 55, according to another alternate embodiment of the present invention.
Figure 18:
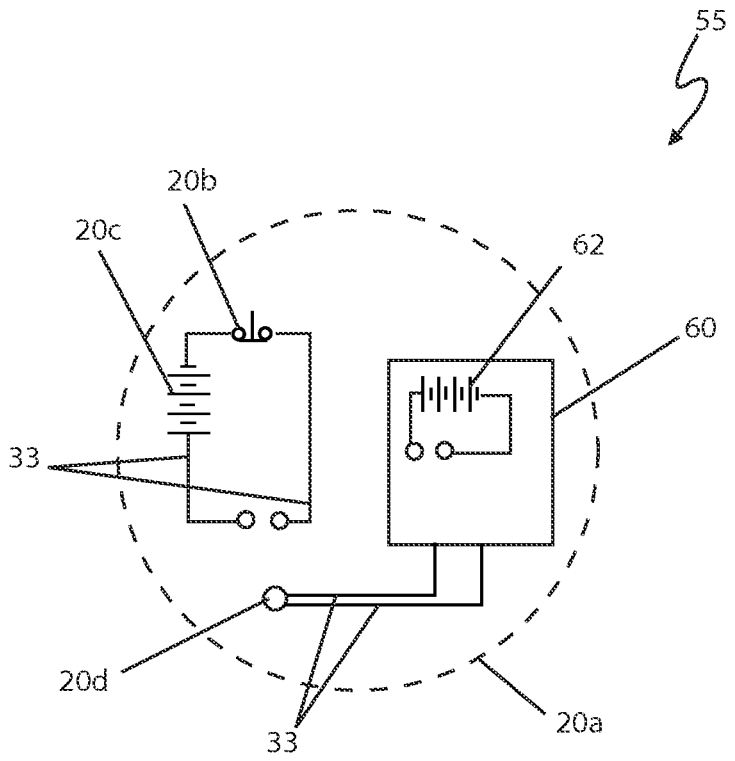

Referring now to FIG. 15 through 18, various views of a second alternate emergency shut-off system 55, according to the preferred embodiment of the present invention, are disclosed. FIG. 15 depicts an environmental view of a second alternate emergency shut-off device 55, FIG. 16 depicts an electrical schematic of the second alternate emergency shut-off device 55, FIG. 17 depicts another electrical schematic of the second alternate emergency shut-off device 55, and FIG. 18 depicts another electrical schematic of the second alternate emergency shut-off device 55. An electric stove 28 is illustrated herein for illustration purposes only it is known that a gas stove 41 may also be utilized without limiting the features of the second alternate emergency shut-off system 55. Said second alternate emergency shut-off system 55 comprises a transmitter 60, a receiver 61, a transmitter power supply 62, and a receiver power supply 63. The transmitter 60 is preferably hard-wired to the smoke detector 20*a* via electrical wiring 33. Said transmitter 60 comprises an internal transmitter power supply 62 that which provides an appropriate amount of current to said transmitter 60. Said transmitter 60 transmits a signal 64 via conventional radio frequencies when smoke is detected from the electric stove 28. The signal 64 is transmitted to a receiver 61 which triggers the power to the electric stove 28 to be terminated. The receiver 61 is appropriately interconnected to the electric stove panel 29 and comprises a receiver power supply 63 that which provides an appropriate amount of current to said receiver 61.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1 through 5, alternately within FIGS. 6 through 9, or alternately within FIGS. 10 through 14, and alternately within FIGS. 15 through 18.

The method of installing and utilizing the system 10 may be achieved by performing the following steps: acquiring the system 10; shutting the circuit breaker box 30 to an off position; moving the electric stove 28 to a position which allows the user to access the stove panel 29; interconnecting the emergency shut-off device 21 to the appropriate output on the smoke detector 20*a* with electric wiring 33, if not previously installed; interconnecting the output of the emergency shut-off device to the outputs on the electric stove panel 29 with electric wiring 33; mounting the smoke detector 20*a* on the ceiling above and offset from the electric stove 28 with appropriate hardware; plugging on the electric stove with the existing first plug 31 to the existing first outlet 32; positioning the electric stove 28 to its original position; utilizing the electric stove 28 normally; allowing the smoke detector 20*a* is detect smoke or high heat from the electric stove 28, thereby sounding the alarm and triggering the emergency shut-off device 21 to trip the circuit breaker box with GFCI 30 to terminate power to the electric stove 28; and, clearing the structure and resetting the system 10 as necessary with the reset button 20*b*.

The method of resetting the system 10 may be achieved by performing the following steps: testing the smoke detector 20*a* as required via the manufacture; and, reducing the effects of fires within a structure.

The method of installing and utilizing the first alternate emergency shut-off system 34 may be achieved by performing the following steps: acquiring the first alternate emergency shut-off system 34; shutting the circuit breaker box 30 to an off position; moving the electric stove 28 to a position which allows the user to access the stove panel 29; interconnecting the emergency shut-off device 21 to the appropriate output on the smoke detector 20*a* with electric wiring 33, if not previously installed; installing the second outlet 37 if not previously installed; installing the junction box 36 and interconnecting to the first outlet 32; interconnecting the junction box 36 to the second outlet 37 with a third plug 39; mounting the smoke detector 20*a* on the ceiling above and offset from the electric stove 28 with appropriate hardware; plugging the electric stove with the existing first plug 31 to the existing first outlet 32; positioning the electric stove 28 to its original position; utilizing the electric stove 28 normally; allowing the smoke detector 20*a* is detect smoke or high heat from the electric stove 28, thereby sounding the alarm and triggering the emergency shut-off device 21 to trip the GFCI thereon the second outlet 37 to terminate power to the electric stove 28; and, clearing the structure and resetting the first alternate emergency shut-off system 34 as necessary with the reset button 20*b*.

The method of resetting the system 10 may be achieved by performing the following steps: resetting the GFCI circuit thereon the second outlet 37; testing the smoke detector 20*a* as required via the manufacturer; and, reducing the effects of fires within a structure.

The method of installing and utilizing the second alternate emergency shut-off system 55 may be achieved by performing the following steps: acquiring the second alternate emergency shut-off system 55; shutting the circuit breaker box 30 to an off position; moving the electric stove 28 to a position which allows the user to access the stove panel 29; interconnecting the emergency shut-off device 21 to the appropriate output on the smoke detector 20*a* with electric wiring 33, if not previously installed; interconnecting the transmitter 60 and transmitter power supply 62 to the smoke detector 20*a* via electrical wiring 33; interconnecting the receiver 61 and receiver power supply 63 to the electric stove 28 via electrical wiring 33; installing the second outlet 37 if not previously installed; installing the junction box 36 and interconnecting to the first outlet 32; interconnecting the junction box 36 to the second outlet 37 with a third plug 39; mounting the smoke detector 20*a* on the ceiling above and offset from the electric stove 28 with appropriate hardware; plugging the electric stove 28 with the existing first plug 31 to the existing first outlet 32; positioning the electric stove 28 to its original position; utilizing the electric stove 28 normally; allowing the smoke detector 20*a* is detect smoke or high heat from the electric stove 28, thereby enabling the transmitter 60 to transmit a signal 64 to the receiver 62 sounding the alarm and triggering the emergency shut-off device 21 to trip the GFCI thereon the second outlet 37 to terminate power to the electric stove 28; and, clearing the structure and resetting the second alternate emergency shut-off system 55 as necessary with the reset button 20*b*.

The method of resetting the system 10 may be achieved by performing the following steps: testing the smoke detector 20*a* as required via the manufacturer; and, reducing the effects of fires within a structure.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An emergency shut-off system for deactivating an electric stove upon sensing smoke or heat and thereby reducing kitchen fires, said electric stove having a first plug connected to a first outlet for receiving power therefrom, said first outlet being electrically mated to a circuit breaker box without a ground fault circuit interrupter, said emergency shut-off system comprising:

a smoke detector including an input and an output respectively, said smoke detector further including a reset button and a battery interconnected thereto;

an emergency shut-off device adapted to be interconnected to the electric stove, said emergency shut-off device further being interconnected to said input and said output of said smoke detector, said reset button being interconnected to said emergency shut-off device;

wherein said emergency shut-off device further includes:

a second plug adapted to be interconnected to a second outlet;

a junction box adapted to be interconnected to the second outlet;

a third plug adapted to be plugged into the second outlet; and, a forty amp contactor having a one-hundred-and-twenty volt alternating current activation coil wired to said third plug, said contactor having a first pair of poles adapted to be interconnected to a two-hundred-and-thirty volt alternating current coming from the circuit breaker, said contactor further having a second pair of poles adapted to be interconnected to the first outlet; and, wherein upon detecting smoke or heat, said smoke detector sends a current to said emergency shut-off device which terminates power to the first outlet and the electric stove.

2. A method of utilizing an emergency shut-off system for deactivating an electric stove upon sensing smoke or heat and thereby reducing kitchen fires, said electric stove having a first plug connected to a first outlet for receiving power therefrom, said first outlet being electrically mated to a circuit breaker box without a ground fault circuit interrupter, said method comprising the steps of:

providing a smoke detector including an input and an output respectively;

providing and interconnecting an emergency shut-off device to the electric stove as well as said input and said output of said smoke detector, wherein the step of providing said emergency shut-off device includes the substeps of:

providing and interconnecting a second plug to a second outlet;

providing and interconnecting a junction box to the second outlet;

providing and interconnecting a third plug into the second outlet; and, providing and wiring a forty amp contactor having a one-hundred-and-twenty volt alternating current activation coil to said third plug, said contactor having a first pair of poles adapted to be interconnected to a two-hundred-and-thirty volt alternating current coming from the circuit breaker, said contactor further having a second pair of poles adapted to be interconnected to the first outlet;

providing and interconnecting a reset button and a battery of said smoke detector to said emergency shut-off device; and, upon detecting smoke or heat, said smoke detector sending a current to said emergency shut-off device and thereby terminating power to the first outlet and the electric stove.

* * * * *